United States Patent [19]

Beck

[11] 4,091,355

[45] May 23, 1978

[54] ANCHORED COIL HEATER

[75] Inventor: Jacob Howard Beck, Waban, Mass.

[73] Assignee: BTU Engineering Corporation, North Billerica, Mass.

[21] Appl. No.: 760,559

[22] Filed: Jan. 19, 1977

[51] Int. Cl.[2] ..... H01C 3/10

[52] U.S. Cl. ..... 338/286; 13/25; 219/347; 219/553; 338/311

[58] Field of Search ..... 338/252, 253, 283, 285, 338/286, 287, 304, 305, 311; 219/347, 349, 345, 353, 355, 357, 552, 553, 461–468; 13/25

[56] References Cited

U.S. PATENT DOCUMENTS

| | | | |
|---|---|---|---|
| 733,610 | 7/1903 | Yates | 338/311 X |
| 848,954 | 4/1907 | Barringer | 338/311 X |
| 1,490,767 | 4/1924 | Curtis | 219/467 X |
| 1,644,255 | 10/1927 | Kercher et al. | 219/465 X |
| 2,051,637 | 8/1936 | Goldbert et al. | 219/347 X |
| 2,091,905 | 8/1937 | Bensel et al. | 219/461 |
| 3,612,829 | 10/1971 | Evans et al. | 219/461 X |

*Primary Examiner*—C. L. Albritton
*Attorney, Agent, or Firm*—Weingarten, Maxham & Schurgin

[57] ABSTRACT

A high temperature coil heater which is supported throughout its length in a manner to achieve substantial exposure of the coil to the product. A helically wound coil of resistance wire is supported continuously along its length by an anchor of electrically insulative high strength high thermal conductivity material and which in turn is bonded to a support member of electrically insulative low thermal conductivity low density material. The anchor embeds only a small segment of each coil turn and a major segment of the coil turns is disposed above the support member for efficient direct radiation to the product. Undesirable heat flow rearward of the coil is restricted by the low conductivity support member.

6 Claims, 4 Drawing Figures

ANCHORED COIL HEATER

FIELD OF THE INVENTION

This invention relates to high temperature heating elements for electrical furnaces and more particularly to an electrical resistance coil heater anchored throughout its length to an insulative material of low thermal inertia.

BACKGROUND OF THE INVENTION

Heating coils formed of helically wound resistance wire are widely employed in high temperature electrical furnaces. Typically such coils are supported by ceramic cores such as grooved plates or cylinders in which the heater is supported and confined throughout its entire length by the ceramic structure. The core usually has a plurality of longitudinal grooves formed in a surface thereof and surrounding the coil around a major portion of its periphery. Typically the groove shields approximately 270° of the coil circumference such that the coil surface is exposed for radiation along a circumferential extent of 90° or less. Alternately the groove is filled with a refractory sealing material such that the coil is fully embedded in a ceramic core. Another known coil heater employs a packed ceramic powder surrounding the heater coil and sheathed by a metal tube.

The weight of the ceramic support structure constitutes a major percentage of the overall heater assembly mass by reason of the amount of ceramic necessary for support of the heating coil and the inherent density of the ceramic material. Such ceramic support structures have relatively low thermal insulation properties and as a result of the relatively massive amount of ceramic material present, a coil heater of conventional construction exhibits a high thermal inertia which limits the rapidity with which a change of temperature can be accomplished. The response of such conventional heaters to temperature control is thereby limited by the relatively slow thermal response of the heater structure. The high thermal inertia also affects the overall efficiency of conventional heaters since the heat must saturate the surrounding ceramic material before direct radiation to the product can significantly occur. The ceramic core even in those conventional heaters having an open groove effectively shades all or a major portion of the direct radiation emitted by the coil thus providing a low emissivity, which in turn promotes a substantial differential in temperature between the product and the heating coil, causing inefficiency and shorter heater life. In those coil heaters employing a packed ceramic powder, air or gases often entrapped within the powder add to the insulative properties of the surrounding material with further unwanted shielding of the heater coil.

SUMMARY OF THE INVENTION

In brief, the present invention provides a high temperature coil heater which is supported throughout its length in a manner to achieve substantial exposure of the coil to the product without a surrounding mass of high thermal inertia. The novel heater comprises a helically wound coil of resistance wire disposed in an intended path and supported continuously along the full length of the coil by an anchor of electrically insulative high strength high thermal conductivity material which embeds only a small segment of each coil turn of the coil. The anchor includes a portion which outwardly extends from the coil throughout the heater path and which is bonded to a support member of electrically insulative low thermal conductivity low density material. A major segment of the coil turns of the heater is disposed above the support member for efficient direct radiation to the product, and heat flow in the direction opposite to the desired radiation direction is restricted by the highly insulative low inertia support member. The heater coil is substantially unencumbered by any surrounding core of high mass, and direct radiation from the coil can occur with minimal unwanted heating of the support and the wall of a furnace on which such support may be mounted. The differential in temperature between the product and the heater coil is substantially lower than that of conventional coil heaters, thus the novel heater is of higher power rating than heaters of conventional construction.

DESCRIPTION OF THE DRAWINGS

The invention will be more fully understood from the following detailed description taken in conjunction with the accompanying drawings in which.

DETAILED DESCRIPTION OF THE INVENTION

Figure 1:
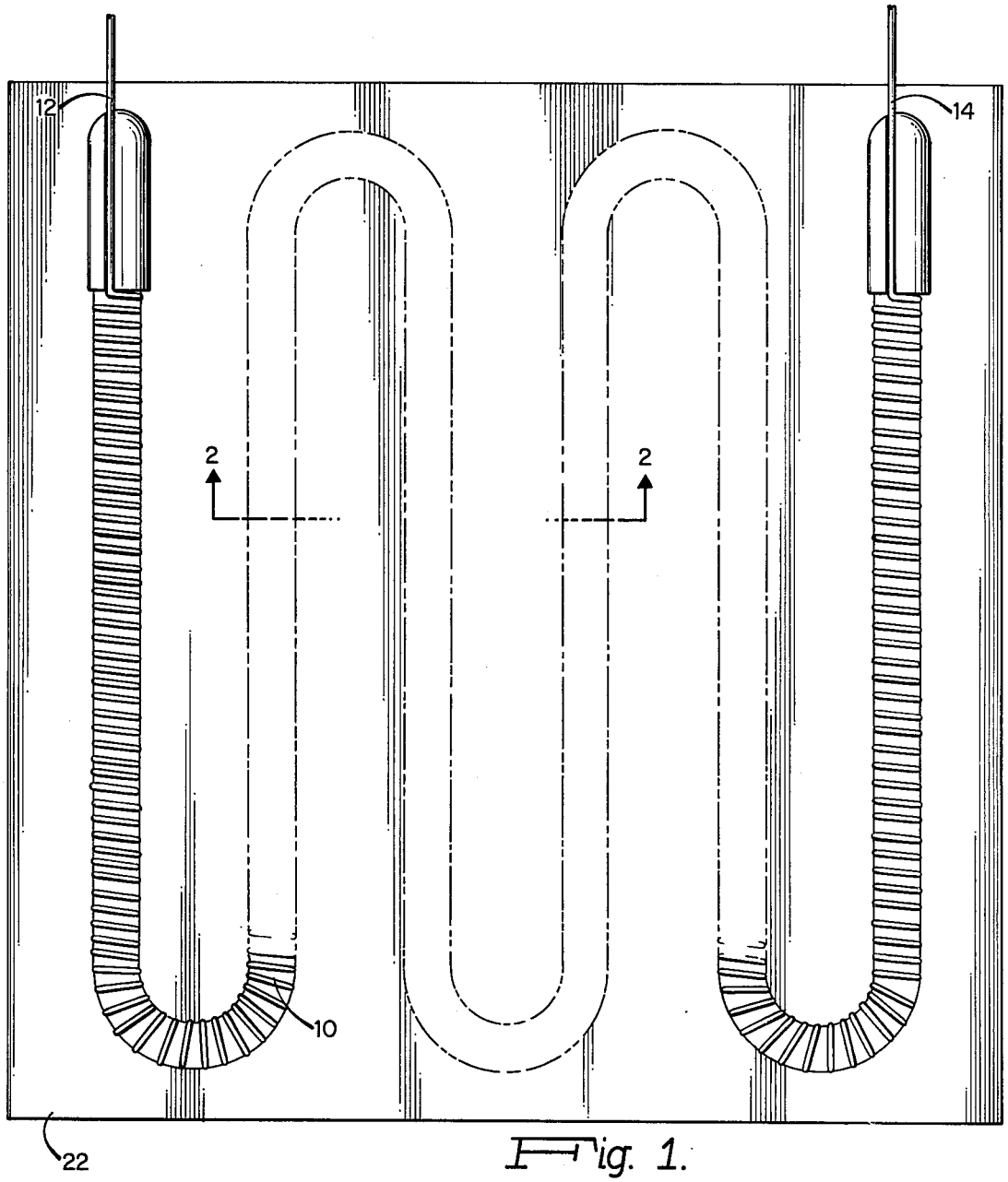
FIG. 1 is a plan view of a coil heater constructed according to the invention.
Figure 2:
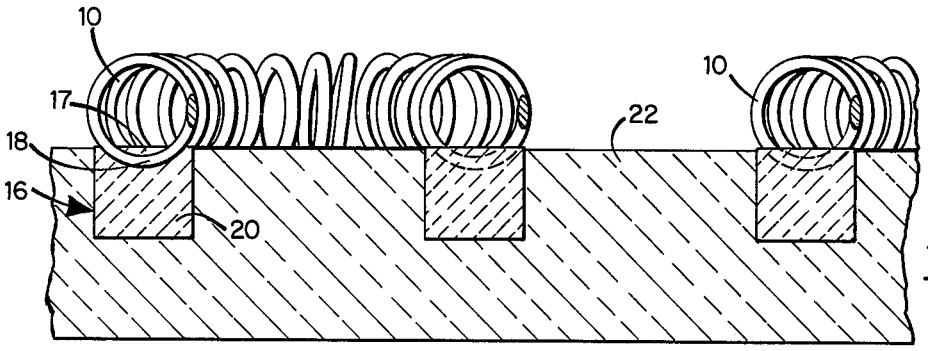
FIG. 2 is a sectional elevation view of the heater of FIG. 1.

The novel coil heater constructed and operative according to the invention is shown in FIGS. 1 and 2 and includes a helically wound resistance wire 10 disposed in a multiple loop serpentine configuration between a first end 12 and a second end 14 which serve as terminals for connection to a source of electrical energy. An anchor 16 is provided along the entire length of coil 10 and is of electrically insulative, high density, high thermal conductivity material.

As best seen in FIG. 2 the anchor 16 has a portion 17 surrounding or embedding a small segment 18 of the coil turns of coil 10, and a portion 20 which outwardly extends from the coil. Thus anchored, the coil turns are fixed relative to one another throughout the heater path to provide a heater coil fully supported along its length. The anchor 16 is bonded to a support member 22 which serves to mount the heater as a unit for installation in a high temperature furnace. Member 22 is of electrically insulative low thermal conductivity and low density material. The anchor 16 is of sufficient strength to support coil 10 along its length and of high thermal conductivity to not materially interfere with the heating performance of coil 10 by insulation of the embedded segments of the coil turns. The anchor 16 is a ceramic such as alumina which typically is cast around the segments 18 of coil 10. The support member 22 is typically a fibrous ceramic material of low thermal inertia and can be composed of alumina or aluminum silicate fibers in an alumina, silica, or other high temperature ceramic bonding material. The fibrous ceramic material is usually cast around portion 20 of anchor 16 and hydraulically set and fired.

The anchor 16 is formed along the entire length of the coil heater and embeds a small segment of each coil turn of the heater to provide continuous support of the heater throughout its length while not materially affecting the heating performance of the coil. In practice the coil turns are embedded only along one-quarter to one-half of the coil circumference thereby allowing a major portion of the coil periphery to be free to radiate directly onto the product. The anchoring material ideally should embed just the confronting portions 18 of the coil turns, but may extend partially into the core of coil 10. The anchor is of high conductivity high density ceramic but is of relatively small cross-sectional area and thus of relatively low overall mass and therefore does not materially affect the thermal performance of the heater. The support member 22 is of low thermal inertia, being of a low density and low thermal conductivity material, and thus only minimal conduction of heat occurs from the coil and anchor 16 to member 22. The support member 22 remains, during heater operation, at a lower temperature than the heater coil and energy is not wasted in the unwanted heating of the coil support structure. The substantially open and unshielded coil can operate with high emissivity to directly heat a product to a high temperature near that of the heater coil itself. The coil heater of the present invention thus can have a higher power rating than conventional coil heaters and exhibits considerable improvement in performance and efficiency over conventional coil heaters.

The coil heater embodiment of FIGS. 1 and 2 is shown within a rectangular support member 22. Such heater is usually associated with other like heaters within a furnace each heater being appropriately energized to provide one or more zones of controlled temperature for a particular heating process. It will be appreciated that the novel heater can be mounted within a support member of any suitable configuration, such as planar or curved, to suit a particular furnace application. The novel heater is in typical use operative for furnace temperature up to 1,300° C.

Figure 3:
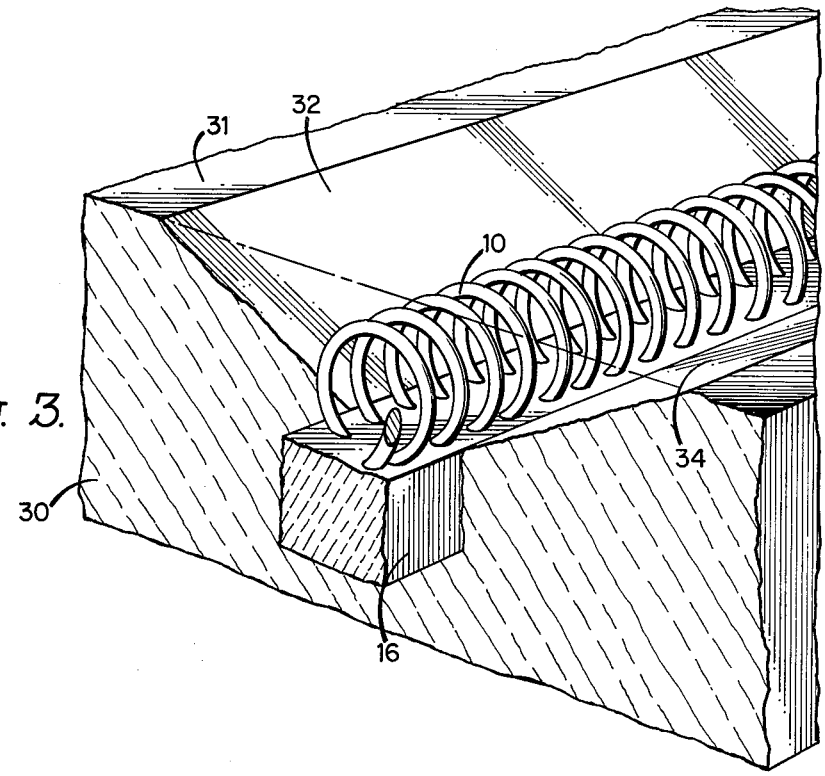
FIG. 3 is a sectional pictorial view of an alternative embodiment of a heater constructed according to the invention.

An alternative embodiment of the invention is shown in FIG. 3 wherein the support member 30 has outwardly flared surfaces 32 and 34 which taper from the anchored coil heater 10 to the outer wall 31 of member 30. The coil is embedded along a segment of its coil turns in anchor 16, which in turn is bonded to support member 30 in the region of juncture of tapering surfaces 32 and 34. The coil 10 is disposed rearward of the plane of wall 31 of member 30 such that the coil will not be short-circuited if a conductive object is placed against wall 31. The flared surfaces 32 and 34 serve as reflectors to direct heat from coil 10 outwardly toward the product in addition to the heat directly radiated to the product by the substantially exposed coil 10.

Figure 4:
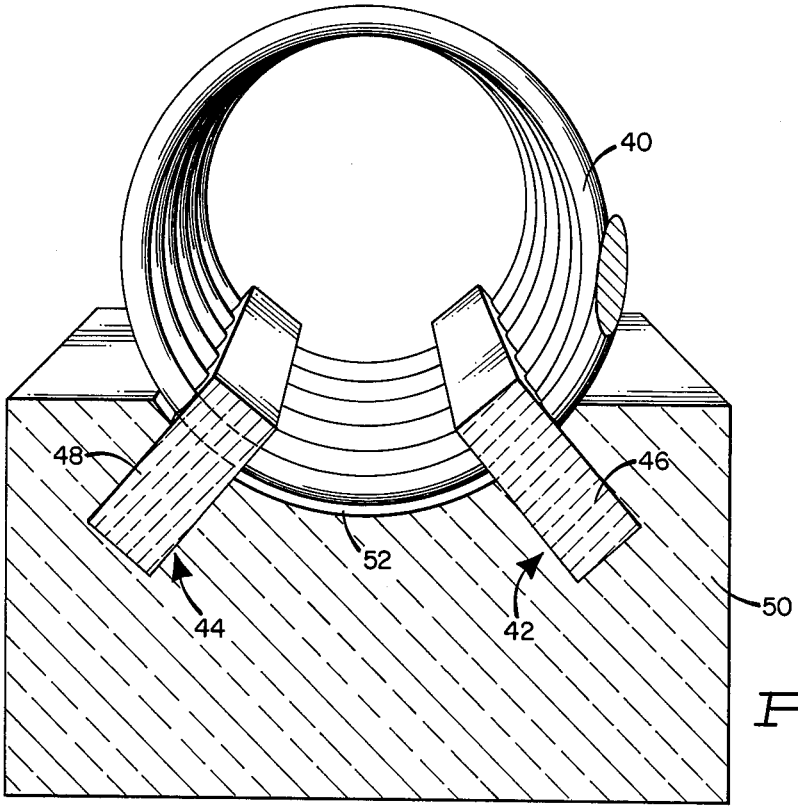
FIG. 4 is a sectional pictorial view of a further alternative embodiment of a heater constructed according to the invention.

For coils of relatively large diameter, typically coils having a diameter of one inch or more, it is preferable to employ multiple anchors for securing the coil along its length while retaining substantial exposure of the coil to the furnace environment. Such embodiment is shown in FIG. 4 and includes a coil heater 40 disposed in an intended heater path and having first and second anchors 42 and 44 angularly disposed from one another and each embedding a respective segment of the coil turns along the full length of the heater. Each anchor 42 and 44 also includes a respective outwardly extending portion 46 and 48 bonded to a support member 50. Member 50 includes a curved trough 52 in which is disposed the confronting turns of heater coil 40 and into which extend the portions 46 and 48 of anchors 42 and 44. The heater coil is thus substantially exposed to the product for efficient heating thereof with only a small portion of the heater turns being surrounded by the high density thermal material of anchors 42 and 44.

The invention is not to be limited by what has been particularly shown and described except as indicated in the appended claims.

What is claimed is:

1. An electrical resistance coil heater comprising:

a helical coil of electrical resistance material disposed along a predetermined path;

an anchor extending along the full length of said coil and of electrically insulative, high strength, high thermal conductivity material;

said anchor having a portion embedding a small segment of each coil turn of said coil throughout said path to fully support said coil throughout its length and having a portion outwardly extending from said coil throughout said path, the anchor being of small cross-sectional area not materially affecting the heating performance of the coil;

a support member of electrically insulative, low thermal conductivity, low density material bonded to the outwardly extending portion of said anchor throughout the length of said anchor to provide a low thermal inertia support for said coil which restricts heat flow in the direction opposite to the desired radiation direction;

said coil having a major segment of the coil turns thereof exposed above said support member and unshielded by said support member and anchor for efficient direct radiation from the coil to a product and minimum unwanted heating of the support member; and electrical terminal means at each end of said coil for connection of the ends of said coil to an electrical power source.

2. The electrical resistance coil heater of claim 1 wherein said support member includes outwardly flared surfaces which taper from said anchor bonded to said support member to the outer wall of said support member to serve as reflectors to direct heat from the coil outwardly toward a product.

3. The electrical resistance coil heater of claim 2 wherein said coil is disposed between said flared surfaces and rearward of the plane of the outer wall of the support member.

4. The electrical resistance coil heater of claim 1 including at least one additional anchor substantially similar to said anchor and extending along the full length of said coil and angularly disposed from said anchor and embedding a respective segment of each coil turn of said coil throughout said path and having an outwardly extending portion bonded to said support member.

5. The electrical resistance coil heater of claim 1 wherein said support member is of a fibrous ceramic material of low thermal inertia.

6. The electrical resistance coil heater of claim 5 wherein said anchor is a high strength ceramic material.

* * * * *